US006604930B1

(12) United States Patent
Lumsden et al.

(10) Patent No.: US 6,604,930 B1
(45) Date of Patent: Aug. 12, 2003

(54) CONCRETE BLOCK MOLDING MACHINERY

(75) Inventors: Howard N. Lumsden, Alpena, MI (US); Lee F. Marzean, Alpena, MI (US); Donald R. Andor, Alpena, MI (US); Michael Ponik, Alpena, MI (US)

(73) Assignee: Besser Company, Alpena, MI (US)

( * ) Notice: Subject to any disclaimer, the term of this patent is extended or adjusted under 35 U.S.C. 154(b) by 410 days.

(21) Appl. No.: 09/619,066

(22) Filed: Jul. 19, 2000

Related U.S. Application Data

(60) Provisional application No. 60/144,757, filed on Jul. 20, 1999.

(51) Int. Cl.[7] ..... B28B 7/44

(52) U.S. Cl. ..... 425/414; 425/420; 425/428; 425/468; 425/812; 249/64

(58) Field of Search ..... 425/414, 427, 425/428, 812, 420, 468; 249/64, 141

(56) References Cited

U.S. PATENT DOCUMENTS

| | | | | |
|---|---|---|---|---|
| 1,699,218 A | 1/1929 | Besser | ..... | 425/253 |
| 2,319,291 A | 5/1943 | Besser | ..... | 425/414 |
| 2,566,787 A | 9/1951 | Zevely | ..... | 425/253 |
| 3,608,162 A | 9/1971 | Staton | ..... | 425/429 |
| 4,235,580 A | 11/1980 | Springs et al. | ..... | 425/211 |

*Primary Examiner*—Robert Davis
*Assistant Examiner*—Thu Khanh T. Nguyen
(74) *Attorney, Agent, or Firm*—Reising, Ethington, Barnes, Kisselle & Learman, P.C.

(57) ABSTRACT

A molding machine for a concrete mix includes a frame with a vibratible mold having a vertical through cavity with hollow cores extending downwardly in the mold cavity. A pallet receiver with a pallet thereon is movable upwardly to close the bottom of the cavity. Core tops have openings therein and ventilation pins are receivable to block air passage through the core top openings when the pallet is in mold closing position. Cups with bottom openings are in the cores below the top openings to receive and guide the pins and passageways around the pins permit suction-braking air to move past the pins to the cup bottom openings when the pins move downwardly away from the core top openings.

10 Claims, 4 Drawing Sheets

FIG - 9
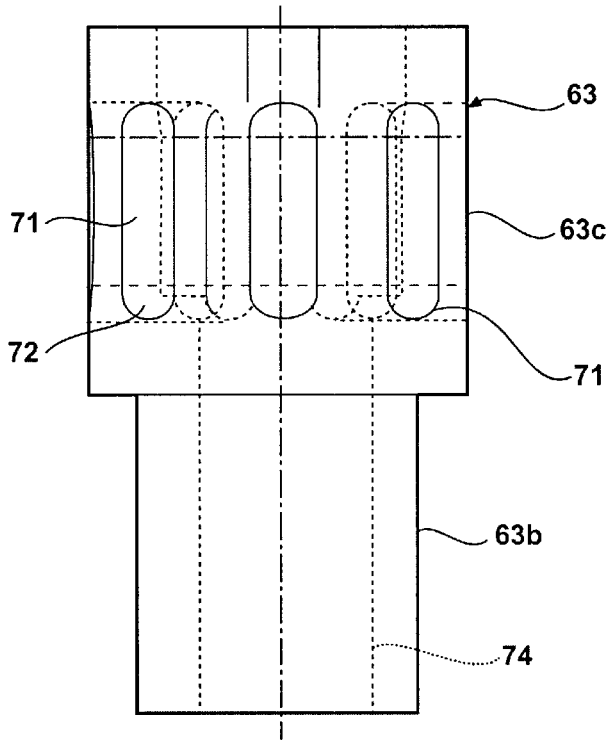
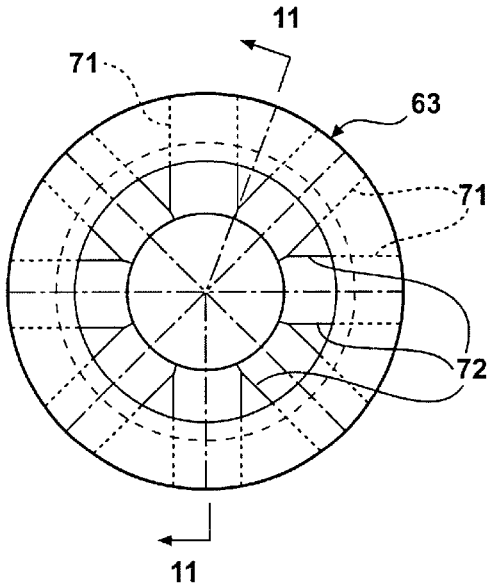
FIG - 10
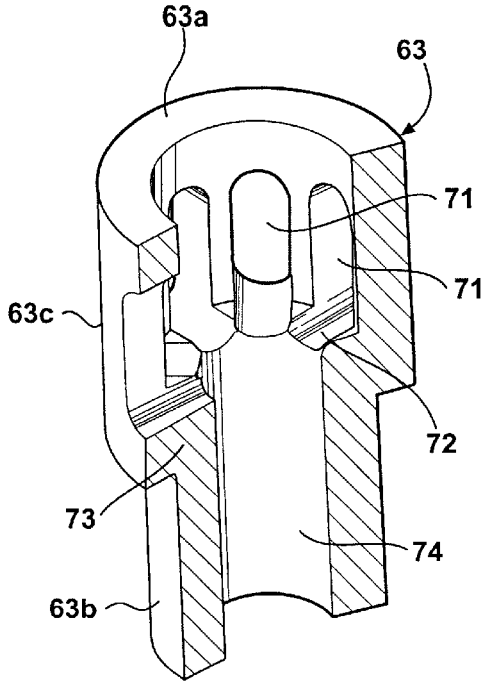
FIG - 11

CONCRETE BLOCK MOLDING MACHINERY

This application claims the benefit of U.S. Provisional Application(s) No(s).: 60/144,757, filed Jul. 20, 1999.

The present invention relates to improved mold ventilation systems used in concrete product molding machines and to methods of making and operating them. The disclosure incorporates concrete block molding machinery disclosed in provisional patent application No. 60/144,757, filed Jul. 20, 1999, whose priority is claimed for this application.

BACKGROUND OF THE INVENTION

Concrete block making machines with vented cores carried by the vibrating molds of the machines are well known and disclosed, for example, in U.S. Pat. Nos. 2,566,787; 3,608,162; and 4,235,580, which illustrate various prior art constructions. The foregoing United States patents are incorporated herein by reference.

The new style ventilation pin system to be described herein substantially reduces the amount of material spillage due to a more precise alignment of the pins with the pin ventilation openings in the top wall of the core assembly and so is saving of material, eliminates prior art manufacturing and assembly problems, and considerably reduces the assembly time required to mount the pin systems in place.

BRIEF SUMMARY OF THE INVENTION

The pin system of the present invention utilizes pin cups, supported by the core plate, which depend into the hollow cores or shells which provide the cavities in concrete blocks, for example. Ventilation providing displaceable pins have heads which are received within the cups to slide up and down in a state of alignment with the cups, and springs are provided between the shanks of the pins and the lower ends of the cups to normally maintain the pins in a position in which the heads of the pins plug the upper ends of the cups when the pallet is bearing on the pin shanks to compress the springs. The pins are designed to plug off the ventilation openings during filling of the mold and during the product compacting and densifying vibration.

The cup walls have slotted external grooves between their upper and lower ends which, when the pin heads descend below the level of the upper ends of the grooves communicate the atmosphere outside the mold with the grooves to admit vacuum breaking air to the interior of the core shells so that they can be readily withdrawn without tending to crumble the block or product formed in the mold during the block stripping operation. As a result of this, suction forces, which otherwise would build within the cavities of the hollow core shells, are relieved by the air flowing in from outside. This vacuum breaking operation occurs when the stripper shoes and pallet receiver move downwardly and the pins are displaced downwardly by the return springs which were compressed by the pallet when it initially was moved upwardly to close the bottom of the mold.

THE DRAWINGS

The presently preferred embodiments of the invention are disclosed in the following description and in the accompanying drawings, wherein:

FIG. 9 is a side elevational view of the cup only;

FIG. 10 is a top plan view thereof; and

FIG. 11 is a perspective sectional elevational view taken on the line 11—11 of FIG. 10.

GENERAL DESCRIPTION OF THE DRAWINGS

Figure 1:
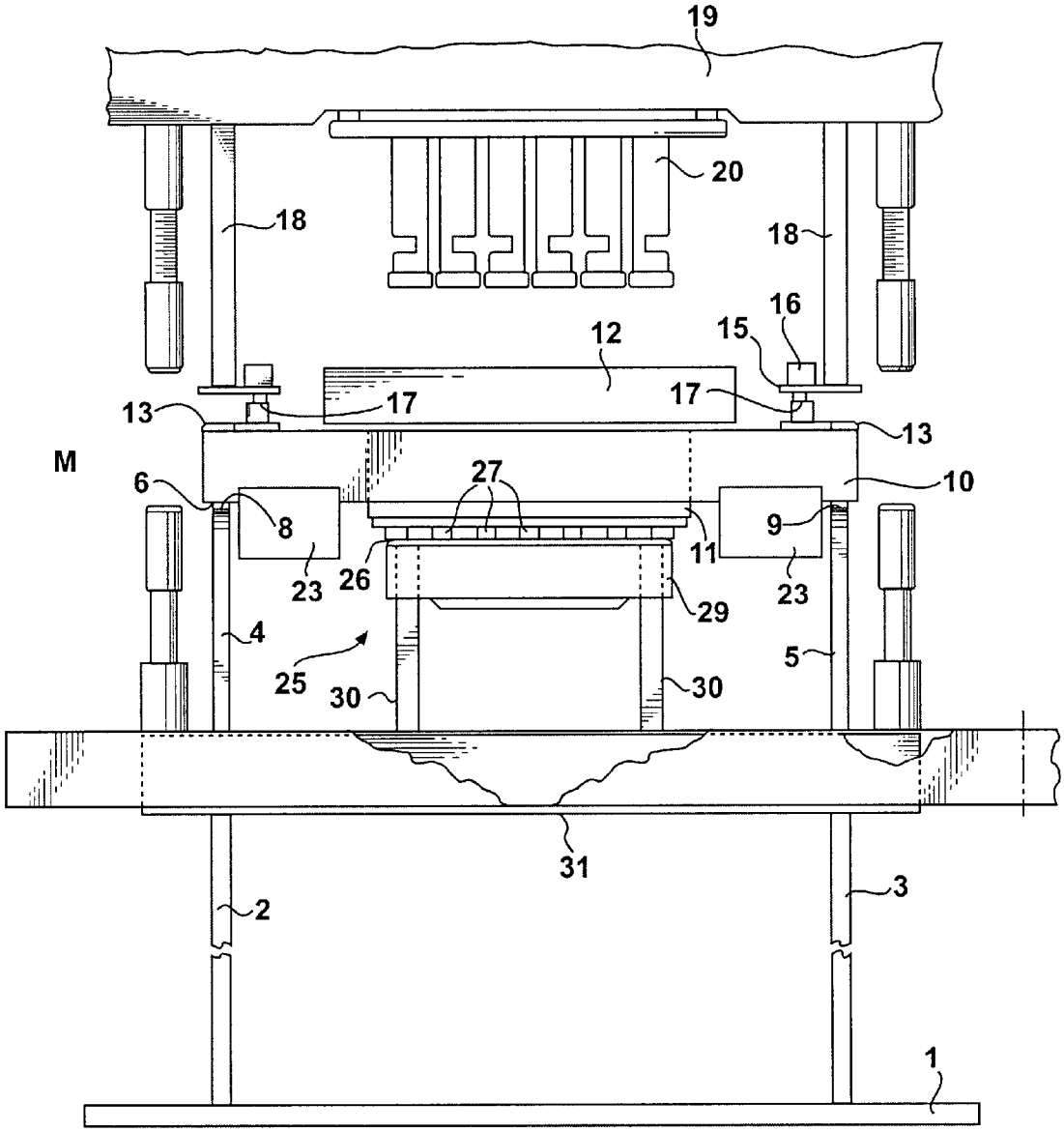
FIG - 1 (PRIOR ART)
FIG. 1 is a schematic side elevational view of a typical block molding machine.

In the drawings, and referring in the first instance to FIG. 1 for a disclosure of a concrete block making machine with which the present invention can be used, a base 1 is shown as provided with an upstanding frame including spaced apart frame members 2 and 3. Between their upper and lower ends, frame members 2 and 3 have forwardly projecting mold supporting arms 4 and 5, respectively, on which the mold, generally designated M, is supported for vibratory movement on throat surfaces 6 and 7 having flat horizontal support surfaces 8 and 9.

Spanning the throats and supported upon the surfaces 8 and 9 when at rest, is the frame 10 of the mold M, which has an open top and an open bottom. As usual, the interior of the mold is shaped to correspond to the block or a plurality of blocks or products of the kind to be molded and a shroud 12 is carried by the mold member 10 and surrounds the open top of the mold M, as is conventional. At opposite ends of the mold frame 10, are secured a pair of fore and aft extending base or lower plates 13. At the forward end of each plate is fixed a bushing 14. Parallel to, but spaced above each plate 13, is a corresponding upper plate 15 at the forward end of each of which is fixed a block 16 from which depends a guide pin 17 which is snugly, but slideably accommodated in the companion bushing 14.

Upper plates 15 are secured to the lower ends of vertical supports 18, which constitute parts of the machine frame and form slide guides for a stripper frame 19, which is vertically reciprocable thereon. The vertically moving frame 19, which can be driven vertically by cams, or alternatively operated by hydraulic cylinders, supports a stripper head 20, which is of such size and shape as to fit snugly, but slideably, within the mold's cavity 11. The mold frame 10 normally rests upon the surfaces 8 and 9 of the throat 6 and 7, but is capable of vertical vibrating movement and is guided in such movement by the guide pins 17. As is conventional, mold frame 10 is fitted with motor driven vibrators diagrammatically shown at 23 for the purpose of vibrating the mold M and densifying the concrete mix therein. The molding machine will include a pallet support or receiver 25 comprising an upper plate 26 fitted with resilient pads 27 atop which a metal pallet 28 may be supported to form a removable bottom for the mold M. The upper plate 26 has a depending skirt 29 within which is accommodated the upper end of a pair of downwardly tapering support arms 30. The upper ends of the arms 30 are fixed to the plate 26 and the lower ends of the arms 30 are welded to a transverse beam 31 which spans the frame members 2 and 3 at the front of the machine. The arms 30 and the beam 31 are movable vertically as a unit by cams or fluid pressure operated cylinders in the usual manner.

Figure 4:
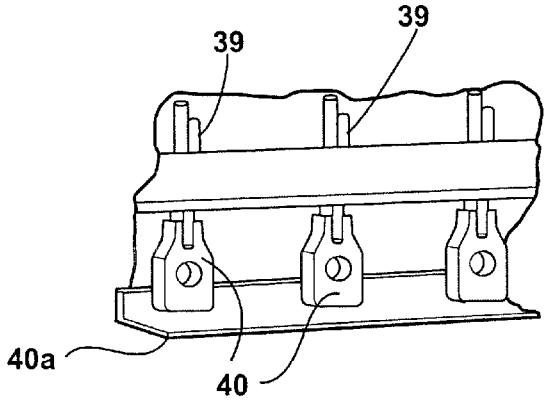
FIG - 4 (PRIOR ART)
FIG. 4 is a fragmentary perspective elevational view of a prior art machine illustrating the manner in which the core plates may typically be secured to the mold.
Figure 5:
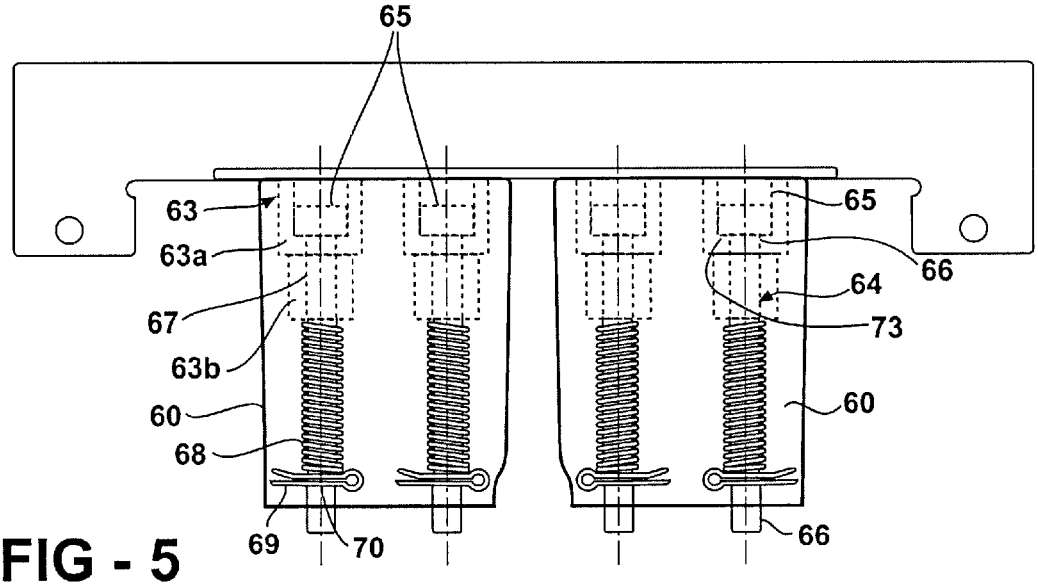
FIG. 5 is a sectional elevational view showing the system of the present invention during the stripping operation when the pallet has moved away from the ventilation pins.
Figure 6:
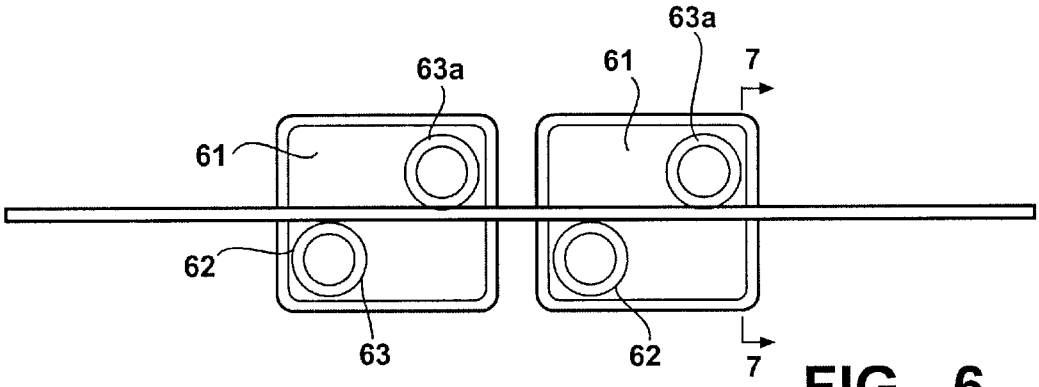
FIG. 6 is a top view showing a core plate and core assembly constructed in accordance with the present invention.

In machines of this character, core assemblies are provided within the mold cavity 11 to form the openings in the concrete block or product. Each core assembly typically includes a series of spaced apart core plates 39 which may be secured to mold plates 40*a* as shown in FIG. 4 by clevises or the like 40.

Figure 2:
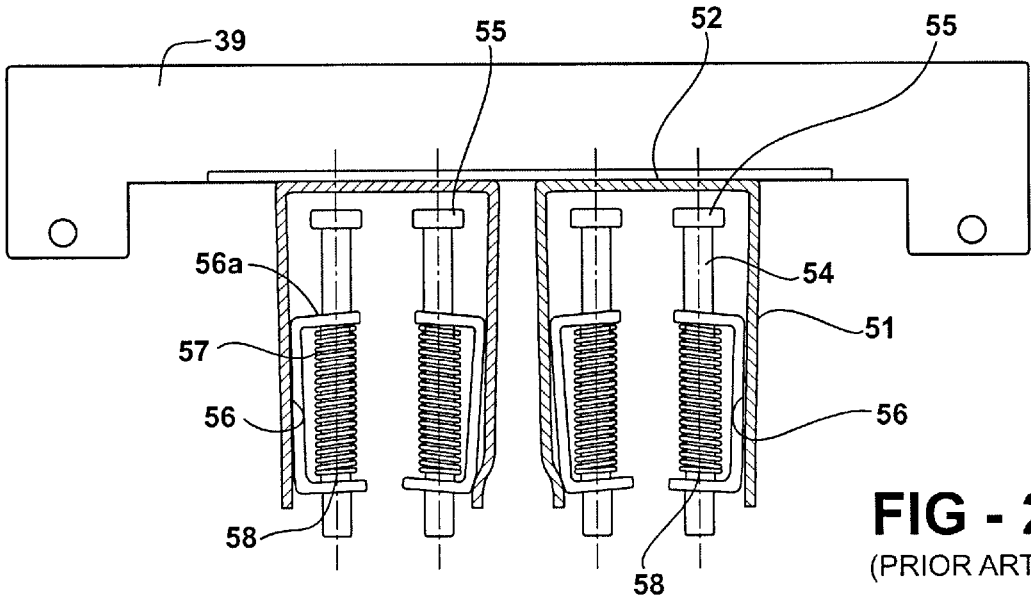
FIG - 2 (PRIOR ART)
FIG. 2 is a side elevational schematic external elevational view of a prior art ventilated core assembly.
Figure 3:
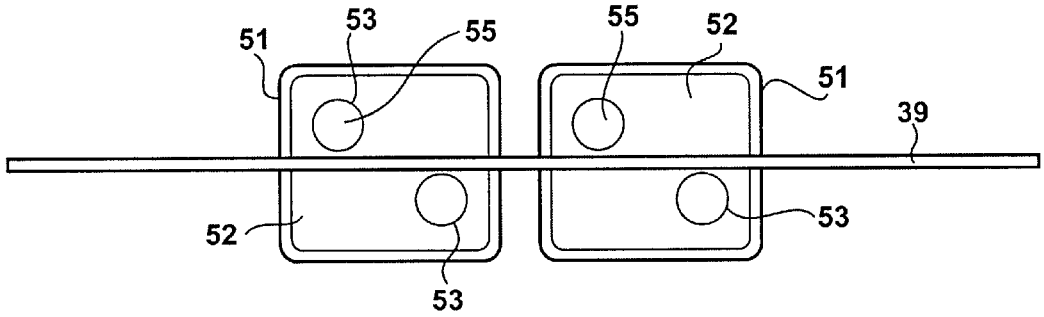
FIG - 3 (PRIOR ART)
FIG. 3 is a top plan view thereof.

Referring now to the prior art construction shown in FIGS. 2 and 3, it will be observed that a series of cover plates 52 for hollow cores or shells 51 are welded to the core plates 39. The core shells 51, which are usually oblong in cross sectional shape and tapered downwardly to facilitate the withdrawal of the green block B which is formed in the mold cavity 11, are open at their lower ends, but closed at their upper ends by top walls 52 having pin openings 53 therein. Below the openings 53 are pins 54 with heads 55. The pins are carried in forged U-shaped hangers 56 welded within the cores 51. It will be seen that springs 57 are provided on the pin bodies 54 between the arms 56*a* of the hangers 56 and cotter pins 58 carried by the pin shanks 54. In this construction, maintaining alignment of the pin heads 55 with the openings 53 is difficult, as is mounting of the hangers 56 in position to seek this.

The construction of the present invention is particularly shown in FIGS. 5–11 and involves core shells 60 which are open at their lower ends and have top plates 61 formed with openings 62 to receive the upper surfaces of guide members 63 having upper end, pin guide cup portions 63*a*, which are upwardly open, and lower reduced diameter portions 63*b*. Pins, generally designated 64, having heads 65 slideably but snugly accommodated in the cups or cup portions 63*a*, extend down through reduced diameter slideable guide openings 66 in the bottom walls or shoulders 73 of cup portions 63*a* and through guide openings 67 provided in the lower portions 63*b*. Yieldable mechanism comprising springs 68 are retained on the pin shanks 66 between the lower ends of cup lower portions 63*b* and cotter pins 69 which extend through openings 70 in the shanks of the pins 64.

Figure 7:
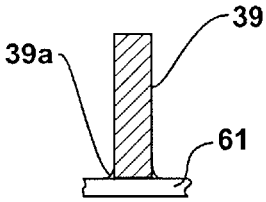
FIG. 7 is a sectional elevational view taken on the line 7—7 of FIG. 6.
Figure 8:
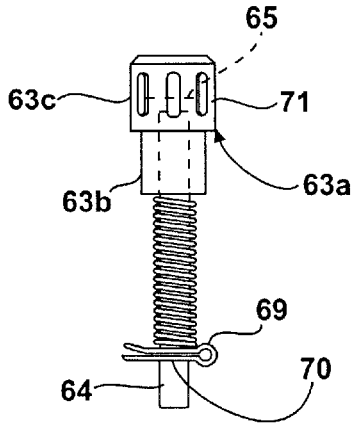
FIG. 8 is a side elevational view of the core pin and cup only.

The top plates 61 can be welded to the beveled lower edge of a plate 39 as shown in FIG. 7 and the cup portions 63*a* are beveled at their upper ends, as shown in FIG. 8, to facilitate their welding to the plates 61 at 39*a*.

As FIG. 8 particularly indicates, the side wall 63*c* of each cup 63*a* is provided with a series of circumferentially spaced through grooves 71 constituting a passageway, which, at their lower ends, communicate with grooves 72 provided as an airway in the lower shouldered portion 73 of the cup portions 63*a*. Ventilation occurs when the heads of the pins descend from a position blocking the grooves 71 to communicate atmospheric air from inside cups 63*a* through grooves 71 (FIG. 8) to break the vacuum. The grooves 72 communicate with the openings 66 and 67.

In operation, during the compacting and molding operation, the pallet 11, which has contacted and compressed the lower ends of the pins 64 when the pallet was raised upwardly on the pallet receiver, maintain the pins 64 in a raised position in which the heads 65 are substantially flush with the upper ends of cups 63*a* and internally block the grooves 71. The springs 68 are compressed when the pins 64 are moved upwardly and then return the pins 64 to the position shown in FIG. 5 when the pallet 11 moves downwardly during the stripping operation. When the pins 64 are snapped downwardly, the grooves 71 are instantly uncovered to circulate vacuum breaking air.

It is to be understood that other embodiments of the invention which accomplish the same function are incorporated herein within the scope of the following patent claims.

We claim:

1. In a molding machine for a concrete mix having:

a frame; a mold having a through cavity with hollow cores, having tops, extending downwardly into the mold cavity; a pallet receiver with a pallet thereon movable from a remote position upwardly to close the bottom of the mold cavity and permit filling of the mold cavity with said mix around said cores from above; said core tops having openings therein and upwardly and downwardly movable ventilation pins receivable to block air passage through said top openings when the pallet is in mold closing position; the improvement wherein:

a. guide cups with side walls and bottoms having bottom openings to pass said pins are provided in said cores below said top openings to receive and guide said pins in relative movement with said cups; and b. passageways around said side walls and pins to permit suction-breaking air to move past said pins to said cup bottom openings when the pins move downwardly in said cups away from said core top openings.

2. The machine of claim 1 wherein said pins have enlarged heads received in said cups and shanks extending through said bottom openings in the cups, and actuating mechanism moves said pins downwardly when said pallet moves downwardly out of mold closing position.

3. The machine of claim 2 wherein said pin shanks in one position extend below said mold cavity; and said actuating mechanism for moving said pins downwardly comprises springs carried by said pins and compressed by said pallet when the pallet is moved to mold closing position.

4. The machine of claim 1 wherein said passageways have lateral airways leading to said bottom openings in said cups.

5. The machine of claim 4 wherein said lateral airways communicate with vertical airways which at their upper ends terminate below the upper ends of said cups.

6. For use in a molding machine for a concrete mix having: a frame; a mold having a vertical through cavity with hollow cores having tops extending downwardly into the mold cavity; a pallet receiver with a pallet thereon movable from a remote position upwardly to close the bottom of the mold cavity and permit filling of the mold cavity with said mix around said cores from above; said core tops having openings therein; the mechanism comprising:

a. a hollow core guide cup assembly including a ventilation pin and a guide cup with side wall portions and a lower wall portion with an opening to pass said ventilation pin provided for one of said cores to receive and guide said pin in relative movement with said guide cup; and b. at least one passageway around said guide side wall portions:and said pin to permit suction-breaking air to move past said pin to said cup guide lower wall opening when said pin moves downwardly in said guide cup away from one of said core top openings; and c. yieldable mechanism adapted to move said pin downwardly when said pallet moves downwardly.

7. The mechanism of claim 6 wherein said pin has an enlarged head received in said cup guide wall portions and a shank extending through said opening in said guide cup, said yieldable mechanism being mounted by said cup for moving said pin downwardly when said pallet moves downwardly out of mold closing position.

8. The mechanism of claim 7 wherein said pin shank in one position is adapted to extend below said mold cavity; and said yieldable mechanism for moving said pin downwardly comprises a spring carried by said pin adapted to be compressed by said pallet when the pallet is moved to mold closing position.

9. The mechanism of claim 6 wherein said guide cup lower portion has a lateral airway communicating with said passageway leading to said opening in said guide cup.

10. The mechanism of claim 9 wherein said passageway comprises a multiplicity of spaced apart vertical airways and said lateral airway comprises a multiplicity of spaced apart lateral airways communicating with said vertical airways which at their upper ends terminate below the upper ends of said guide cup wall portions.

* * * * *